US005222925A

United States Patent [19]

Maycock et al.

[11] Patent Number: 5,222,925

[45] Date of Patent: Jun. 29, 1993

[54] DEVICE AND METHOD FOR WRIST EXERCISE

[76] Inventors: Sidney M. Maycock, 37 Washington Ave., Williamstown, N.J. 08094; Garrison Y. Pomeroy, 1415 E. Rte. 70 Ste. 502, Cherry Hill, N.J. 08034

[21] Appl. No.: 946,604

[22] Filed: Sep. 18, 1992

[51] Int. Cl.[5] ..... A63B 5/00

[52] U.S. Cl. ..... 482/44; 482/46; 482/47; 482/907; 482/132; 128/26

[58] Field of Search ..... 128/26, 57, 60, 67; 482/44, 45, 46, 47, 48, 79, 80, 907, 131, 132

[56] References Cited

U.S. PATENT DOCUMENTS

| | | |
|---|---|---|
| 1,497,243 | 6/1924 | Martin . |
| 2,819,081 | 1/1958 | Touraine . |
| 3,472,508 | 10/1969 | Baker et al. . |
| 4,380,231 | 4/1983 | Rocha et al. . |
| 4,641,832 | 2/1987 | Mattox . |
| 4,836,531 | 6/1989 | Niks . |
| 4,901,999 | 2/1990 | Schott . |
| 4,957,442 | 9/1990 | Prater . |
| 5,135,450 | 8/1992 | Smith, IV ..... 482/80 |

*Primary Examiner*—Richard J. Apley
*Assistant Examiner*—Jeanne M. Mollo
*Attorney, Agent, or Firm*—Thomas A. Lennox

[57] ABSTRACT

An exercise device and method to exercise the wrist and hand of a person at the work station on a desk surface includes a base with a curved bottom surface with front and rear upper horizontal members, the front with finger rings to receive the ends of the digits of the middle fingers while resting the wrist on the rear horizontal member. Upper sections of the base are separate and are rotatably adjustable to fix a chosen distance between the two upper horizontal members. The device is used by rocking the device frontwardly and backwardly on the curved surface to exercise and flex the wrist in all six directions.

13 Claims, 4 Drawing Sheets

DEVICE AND METHOD FOR WRIST EXERCISE

BACKGROUND OF THE INVENTION

This invention involves a device and method of using the device to facilitate essentially all exercise of a person's hand and wrist. More specifically, the device definitely aids in wrist flexion and extension as well as ulnar and radial deviation, and is even effective for supination and pronation of the hand and wrist.

The incidence of carpal tunnel syndrome is a relatively common malady among persons using the wrist and hands, including typists, dental hygienists, piece workers, chiropractors, meat cutters and the like. Carpal tunnel syndrome involves breakdown of the tunnel such that the median nerve is aggravated or possibly injured in contact with the bones of the wrist. Surgery has certainly not always been successful and entails risk. Immobilization cocks the wrist to take pressure off the median nerve. While a variety of treatments have been suggested, including surgery, none of the treatments provide an absolute answer to the problem. Further, racket sports such as tennis and racquetball sometimes cause the player to strain a tendon, pull a muscle and generally suffer from various ailments grouped under the title "*Tennis Elbow*". Manipulation can in many cases improve the positioning of the bones and ligaments to reduce pressure on the median nerve. Physical therapy including ultrasound is sometimes effective in combination with other techniques. Absolute abstinence from using the hand and arm is sometimes prescribed. Stretching and strengthening exercises have been recommended and are effective in treating the syndrome. However, the techniques are difficult to master to achieve the best results.

Various devices such as the hand and wrist exercising device of U.S. Pat. No. 4,836,531 to Mikhail Niks describes a device which is used to exercise the wrist through a pronation and supination movement. The exerciser device described in U.S. Pat. No. 2,819,081 to John Touraine describes a device also to exercise the wrist and arm in a rotating movement. None of the above devices or any of the various treatments have provided a satisfactory solution alone or in combination to treat tennis elbow and/or carpal tunnel syndrome.

SUMMARY OF THE INVENTION

It is an object of the present invention to provide a device and method that will aid a person in the exercise of the hands, wrist and lower arm in essentially all movements to the fullest degree of movement possible.

It is an additional object to provide a device and method to achieve full movement in the three couplets of flexural and extension, ulnar and radial deviation, and even pronation and supination.

It is a further object of the present invention to provide a device that will allow support for the hand and wrist and aid in hand and wrist exercises with the movement of the device maintaining a proper rocking action to aid in the exercise.

A particular object of the present invention is to provide a full flexural movement of the small bones in the wrist to aid in manipulation and improve the condition of the carpal tunnel syndrome sensory involvement sufferer.

It a particular object of the present invention to provide a device that may be kept at the person's work station to be used at regular intervals to stretch the fatigued members and aid in the prevention of carpal tunnel syndrome.

It is a specific object of the present invention to provide a device on which the person rests the ends of the fingers on one horizontal member and supports the wrist at the break on a rear horizontal member and that the distance between those horizontal members is adjustable and fixed for various hand sizes.

An aspect of the invention is a device on which a person can place a wrist and ends of digits two through four, all of one hand, to rock the device on a surface to aid in exercising. The device includes two upper horizontal members each including two ends and a length with a horizontal top surface. The device further includes two body members each including two upper ends and a curved bottom surface that includes a center section that can rest on the surface and in combination support the device, and two rounded sections extending from the center section in opposite directions. The device also includes connection means to connect the two body members to fix the bottom surfaces in a parallel relationship to each other, wherein the bottom surfaces are in a curved plane which abuts the surface as the device is rocked back and forth. The device further includes attachment means to attach the ends of the two upper horizontal members to the upper ends of the two body members and to fix the horizontal top surfaces of the two upper horizontal members in parallel relationship to each other at a distance from each other that when the wrist of the one hand is rested flat on one horizontal top surface the tips of digits two through four of the hand span the distance and can rest on the opposite horizontal top surface, and above the curved plane a sufficient distance that when the wrist of the one hand is rested flat on one horizontal top surface and the tips of digits two through four of the hand are rested on the opposite horizontal top surface and the device is rocked back and forth on the curved plane, the maximum range of motion of the wrist is reached.

It is preferred that the attachment means be adjustable to adjust the distance between the horizontal top surfaces of the two upper horizontal members without changing length or shape of the curved plane. It is also preferred that the attachment means include extension members extending from each upper end of the body members, wherein the ends of the two upper horizontal members are rigidly connected to the extension members, and that the attachment means further include pivot connection means pivotally connecting lower ends of the extension members to the upper ends of the body members allowing the distance between the two upper horizontal members to be adjusted and fixed in a chosen position. It is further preferred that the center sections of the curved bottom surfaces be about one inch long and be curved end to end on a line with a radius of at least about four inches and the rounded sections of the bottom surfaces have a radius of about one to about three inches. It is more preferred that the center sections of the curved bottom surfaces be about one inch long and are curved end to end on a line with a radius of about three inches to about ten inches. It is most preferred that the center sections of the curved bottom surfaces be about one inch long and be curved end to end on a line with a radius of about five inches and the rounded sections of the bottom surfaces have a radius of about two inches. It is also preferred that a distance of upper horizontal surfaces above the center sections of the curved bottom surfaces be about three to five inches, and more preferred be about four inches. It is further preferred that the length of the upper horizontal surfaces and a distance between the curved bottom surfaces both be about four inches. It is preferred that at least one and more preferably only one of the upper horizontal members include a plurality of rings positioned horizontally and sized to receive ends of the digits of the hand. It is further preferred that the attachment means rotatably attaches the upper horizontal member comprising a plurality of rings to allow it to turn around a lengthwise axis.

Another aspect of the invention is a method of a person exercising a wrist that includes providing a device as described above. The method further includes placing the device on a flat surface resting on the curved bottom surfaces and placing a wrist on the horizontal top surface of one of the upper horizontal members and at least one end of digits two through four of the same hand on the horizontal top surface of the remaining upper horizontal member spanning the distance between the horizontal top surfaces, and rocking the device back and forth repetitively on the curved plane of the curved bottom surfaces. It is preferred that the method further include providing the device wherein at least one of the upper horizontal members comprises a plurality of rings positioned horizontally and sized to receive ends of the digits of the hand, and then inserting ends of the digits of the hand into the rings and resting an inside surface the wrist on the remaining upper horizontal member prior to rocking the device.

DESCRIPTION OF THE PREFERRED EMBODIMENTS

Figure 1:
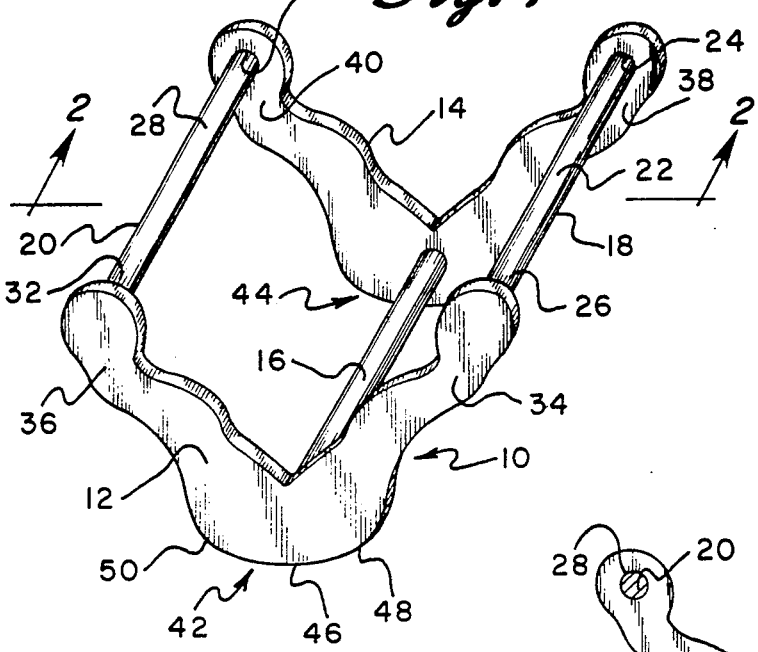
FIG. 1 is a perspective view of a device of the present invention.
Figure 2:
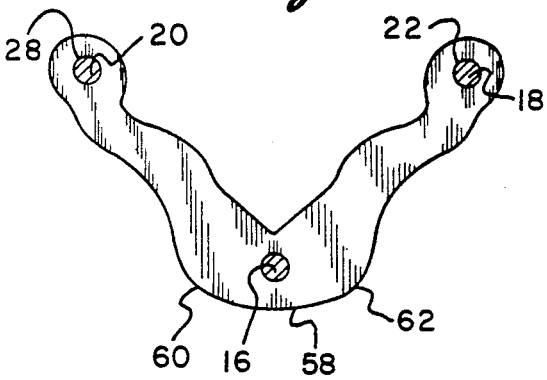
FIG. 2 is a cross-sectional view taken along 2—2 of FIG. 1.

Exercise device 10 is illustrated in FIG. 1 constructed of left body member 12 and right body member 14 connected through horizontal rod connection member 16, rear upper horizontal member 18 and front upper horizontal member 20. All of these members may be constructed of a variety of materials including thermoplastic polymers, wood, aluminum and any of the various materials of that class. It is preferably light in weight and may be connected in to a integral unit permanently or may be able to be broken down by providing that each member force fit into the other. Device 10 may be used in any horizontal position and the sides are identified for clarity purposes only. Rear upper horizontal member 18 is connected at end 24 to upper end section 38 of right body member 14 and at end 26 to upper end section 34 of the left body member 14. Likewise, front upper horizontal member 20 is connected at end 30 to upper end section 40 of right body member 14 and at end 32 to upper end section 36 of left body member 12. Horizontal member 18 provides horizontal top surface 22 while front horizontal member 20 provides horizontal top surface 28. With body members 12 and 14 connected together, a curved rocking plane is formed by curved bottom surface 42 of member 12 and curved bottom surface 44 of member 14 on which device 10 rocks forwardly and backwardly to aid in the exercise of the hand and wrist. Curved bottom surface 42 includes center section 46 as well as rear curved end section 48 and front curved end section 50. The sections of curved bottom surface 44 are shown in FIG. 2 consisting of center section 58, front curved section 60 and rear curved section 62. In this embodiment, the center sections of bottom curved surfaces 42 and 44 are each about one inch long with a curvature of a radius of about five inches with the front and rear curved sections having a radius of about two inches. The vertical distance between a line drawn between upper horizontal surfaces 22 and 28 and a line drawn between center sections 46 and 58 is about four inches. The length of the upper horizontal surfaces are both about four inches.

Figure 3:
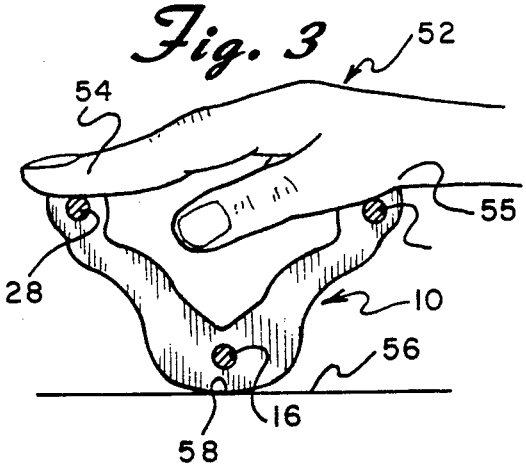
FIG. 3 starting position shows use of the device illustrated in FIGS. 1 and 2 in a flexural extension exercise.
Figure 3A:
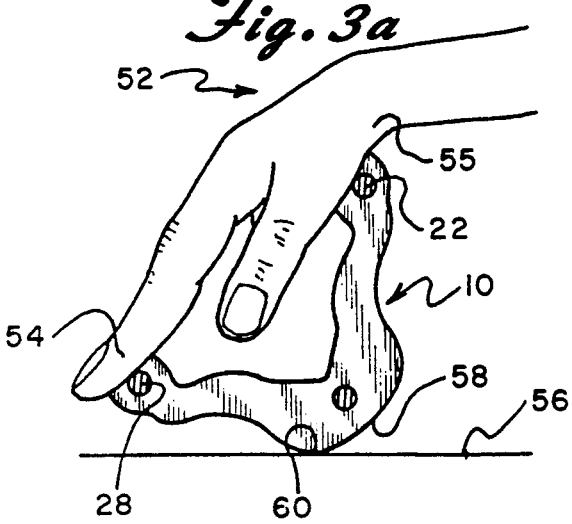
FIG. 3*a* shows use of the device thereof in flexure.
Figure 3B:
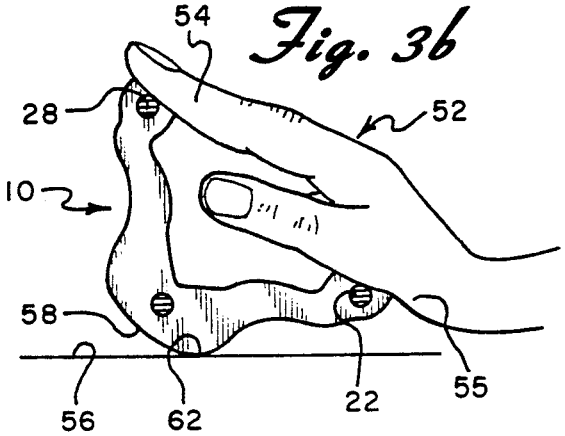
FIG. 3*b* shows use of the device thereof in extension.
Figure 4:
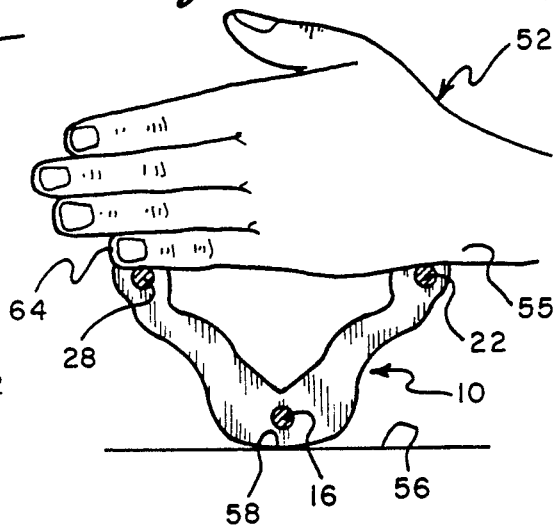
FIG. 4 show the use of the device illustrated in FIGS. 1 and 2 with a pronation exercise.
Figure 4A:
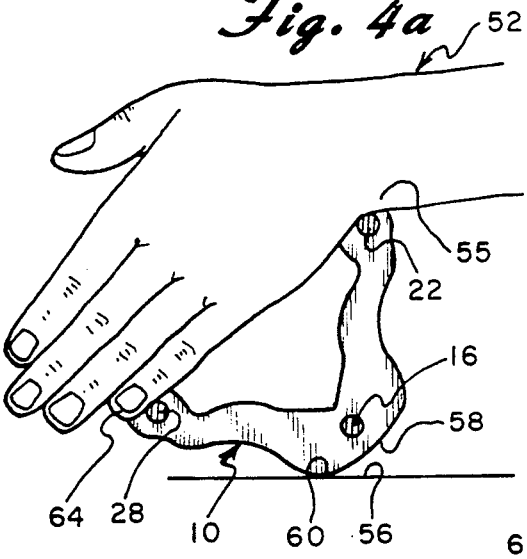
FIG. 4*a* shows use of the device thereof in ulnar deviation.
Figure 4B:
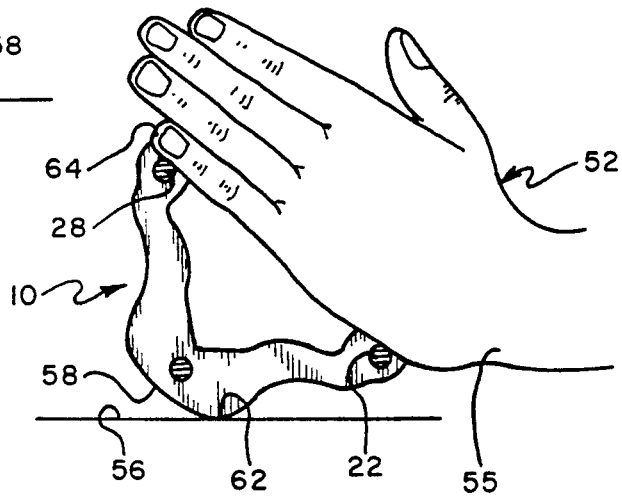
FIG. 4*b* shows use of the device thereof in radial deviation.

In FIGS. 3 through 4*b*, use of device 10 is illustrated. FIGS. 3 through 3*b* illustrate flexion and extension movements while FIGS. 4 through 4*b* illustrate ulnar and radial deviation movements. In FIG. 3, hand 52 is placed on device 10 resting digits 54 two through four (digits three and four are hidden) on front horizontal top surface 28 and the inside of wrist 55 on rear horizontal top surface 22 spanning the distance of about six inches between these upper horizontal surfaces. Device 10 rests with center sections 46 and 48 resting on table surface 56. In FIG. 3*a*, pressure is applied by the digits to rock the device 10 forwardly on front curved sections 50 and 60 bending wrist 55 in a flexion movement up to a maximum range of movement of about eighty degrees. While continuing to maintain the digits 54 and wrist on the upper horizontal surfaces, device 10 is rocked rearwardly as illustrated in FIG. 3*b* rocking the device onto rear curved end sections 48 and 62 conducting an extension exercise up to a maximum range of motion of about seventy degrees. This exercise is repeated a multiplicity of repetitions for best benefit. To conduct the ulnar and radial deviation exercise hand 52 is placed on device 10 as illustrated in FIG. 4 with the end of digit four 64 resting on front upper surface 28 and side of wrist 55 resting on rear upper horizontal surface 22 with the hand 52 in a generally vertical position. Again at the start of this exercise, and when at rest, device 10 rests on center sections 46 and 58. In conducting ulnar deviation movement, as illustrated in FIG. 4*a*, device 10 is rocked forwardly so that it rests on front curved sections 50 and 60 to attain a maximum range of motion of about thirty degrees. Continuing exercise as illustrated in FIG. 4*c*, device 10 is rocked rearwardly so that it rests on rear curved end sections 48 and 62 on table surface 56 to achieve radial deviation up to a maximum range of motion of about twenty degrees. Although not illustrated, the device can also provide a pronation and supination exercise. The thumb and little finger (first and fifth digits) are stretched across the device, one resting on the front horizontal surface 22 and the other resting on the rear horizontal top surface 28. Again, the device is rocked forwardly and rearwardly on the curved plane of the bottom surfaces 42 and 44 to achieve a range of motion close to the maximum.

Figure 5:
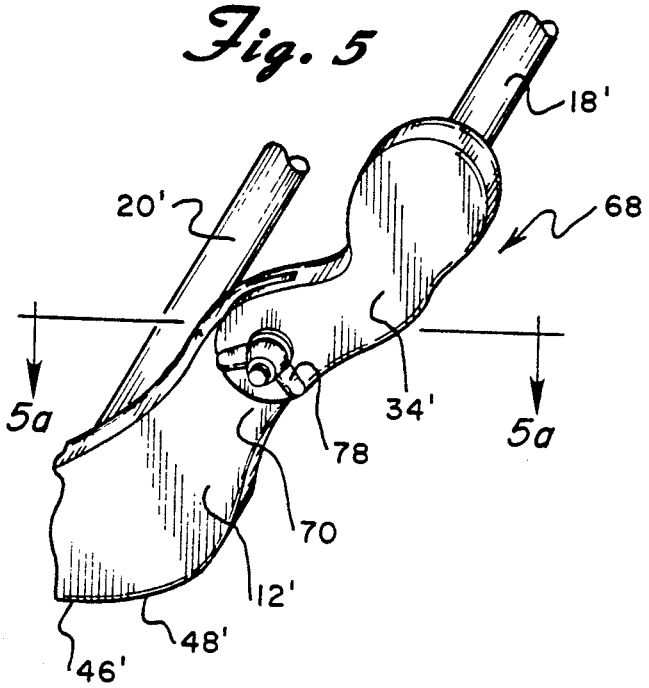
FIG. 5 is a partial perspective view a second embodiment of the invention.
Figure 5A:
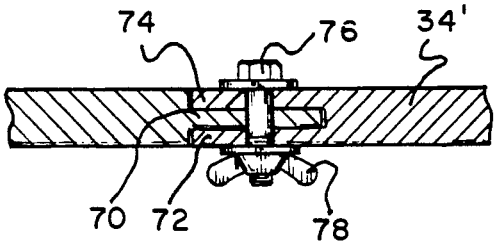
FIG. 5*a* is a cross-sectional view taken along lines 5*a*—5*a* of FIG. 5.
Figure 6:
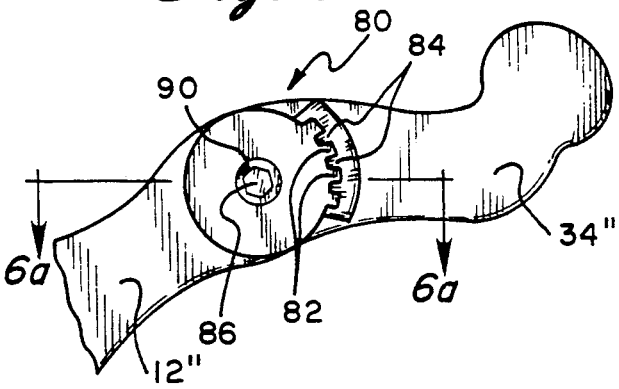
FIG. 6 is a partial front elevational view of a third embodiment of the invention.
Figure 6A:
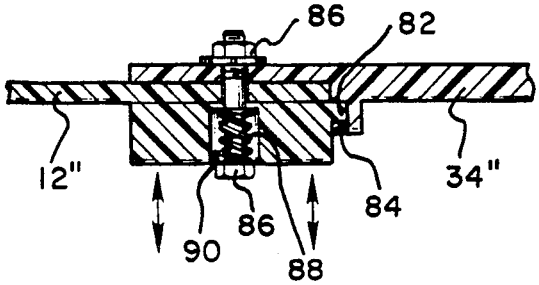
FIG. 6*a* is a cross-sectional view taken along lines 6*a*—6*a* of FIG. 6
Figure 6C:
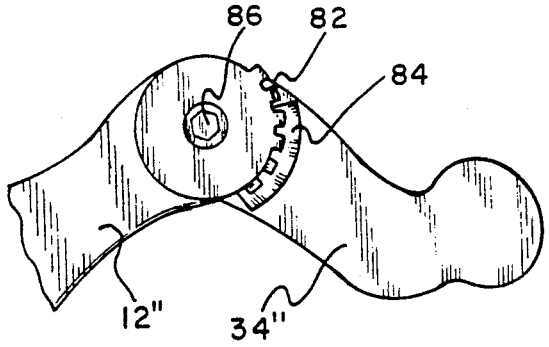
FIG. 6*c* is a cut-away front elevational view similar to FIG. 6 with the extensions rotated.
Figure 7:
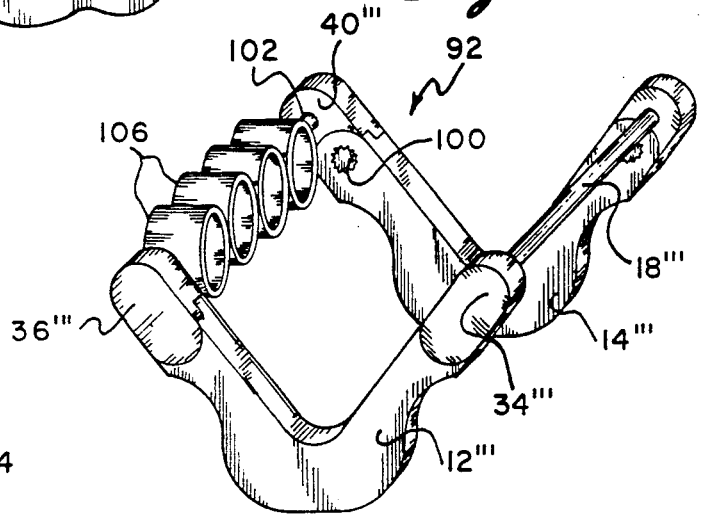
FIG. 7 is a perspective view of a fourth embodiment of the invention.
Figure 6B:
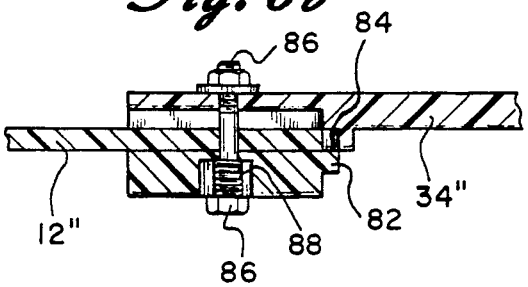
FIG. 6*b* is a cross-sectional view similar to FIG. 6*a* with the attachment disengaged.
Figure 7A:
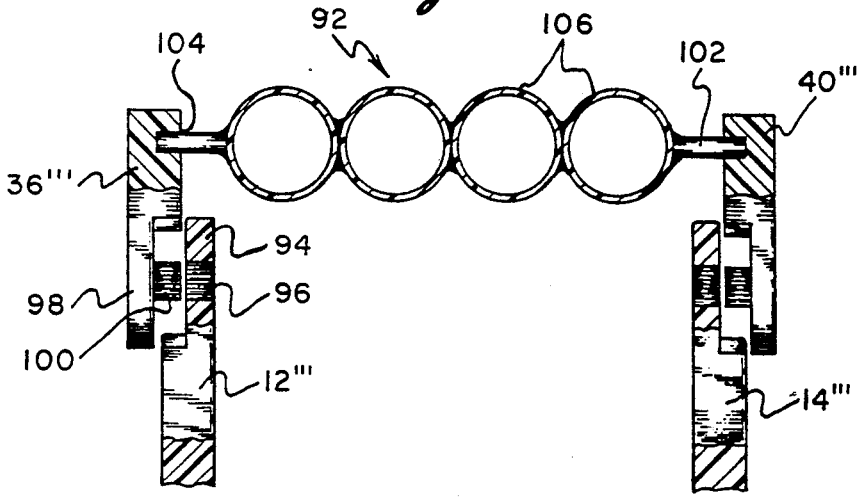
FIG. 7*a* is a partial cross-sectional view taken along lines 7*a*—7*a* of FIG. 7.

The balance of the embodiments illustrated in the later figures all include mechanisms to adjust the distances between the upper horizontal surfaces. It also should be understood that the invention includes a continuous horizontal surface stretching between the front and rear upper horizontal surfaces. To conserve material and to limit the weight of the device it is preferred to provide an adjustment that allows the distance between the upper horizontal surfaces to be reduced to about five inches and increased to about seven inches to compensate for different hand sizes. In FIG. 5, and all subsequent figures all similar elements to that of device 10 are designated with a "prime" or multiple "primes" after any number designation identifying an element of device 10. In device 68, as shown in FIG. 5, all the upper end sections of the body members are separate part extensions although only upper end section 34' is illustrated. Upper end 70 of left body member 12' interfits between depending sections 72 and 74 of upper end section 34'. Bolt 76 extends through aligned holes through sections 72 and 74 and end 70 sandwiched between the two depending members. Wing nut 78 pressures the three parts together to hold upper end extension 34 in any chosen position. The balance of device 68 is similar to device 10 and similar attachments are provided for the balance of the three upper end sections/extensions 36', 38', 40', not illustrated herein. A portion of device 80, again like device 10 where not shown, is illustrated in FIG. 6, showing connection between the body members and the separate but connected upper end extensions 34'', 36'', 38'', and 40''. Spaced teeth 82 are positioned on a convex arc on the ends of base body member 12''. As shown in FIG. 6 teeth 82 engage complimentary teeth 84 opposed and extending from a concave surface of upper end extension 34''. As further illustrated in FIG. 6*a*, the two parts are held together in pivotal connection by bolt 86 with spring 88 positioned in recess 90 allowing body member 12'' to be biased away from engagement of extension 34'', to disengage teeth 82 and 84 from each other. As shown in FIG. 6*b*, this mechanism allows the radial alignment of member 34'' from body member 12'' to change the length between the upper horizontal surfaces as illustrated in FIG. 6*c*. Once aligned to the right distance, engagement is released to allow the teeth to reengage under spring pressure to hold the device as illustrated in FIG. 6*a*. Device 92 as shown in FIGS. 7 and 7*a* incorporates an alternative embodiment for adjustment of distance between the upper horizontal surfaces as well as a modified front upper horizontal member 102. Adjustment of the length between the upper horizontal surfaces is attained by providing upper end 94 of base member 12''' with serrated hole 96 and providing a complimentary overlapping extension 98 with ridged pin 100 force interfitting into hole 96 in various radial positions to adjust the angle between extension member 36''' and base member 12'''. Front horizontal member 102 includes round rod ends which interfit into horizontal holes 104 on the inside surfaces of extension members 36''' and 40''' with a force fit, but allowing the member to be rotated in position for other exercises. Rings 106 are sized to receive the fingers of the hand for improved stability of the device during exercise of flexion and extension. Rear upper horizontal member 18''' is identical to that of member 18 in device 10.

While this invention has been described with reference to the specific embodiments disclosed herein, it is not confined to the details set forth and the patent is intended to include modifications and changes which may come within and extend from the following claims.

I claim:

1. A wrist flexion and extension excercise device on which a person can place a wrist and ends of digits two through four of one hand to rock on a surface to aid in exercising, the device comprising:

(A) two upper horizontal members each comprising two ends and a length with a horizontal top surface, (B) two body members each comprising:

(i) two upper ends, and (ii) a curved bottom surface comprising:

(a) a center section that can rest on the surface and in combination support the device, and (b) two rounded sections extending from the center section in opposite directions, (C) connection means to connect the two body members to fix the bottom surfaces in a parallel relationship to each other, wherein the bottom surfaces are in a curved plane which abuts the surface as the device is rocked back and forth, and (D) attachment means:

(i) to attach the ends of the two upper horizontal members to the upper ends of the two body members, and (ii) to fix the horizontal top surfaces of the two upper horizontal members:

(a) in parallel relationship to each other at a distance from each other that when the wrist of the one hand is rested flat on one horizontal top surface the tips of digits two through four of the hand span the distance and can rest on the opposite horizontal top surface, and (b) above the curved plane a sufficient distance that when the wrist of the one hand is rested flat on one horizontal top surface and the tips of digits two through four of the hand are rested on the opposite horizontal top surface and the device is rocked back and forth on the curved plane, the maximum range of motion of the wrist is reached.

2. The device of claim 1 wherein the attachment means is adjustable to adjust the distance between the horizontal top surfaces of the two upper horizontal members without changing length or shape of the curved plane.

3. The device of claim 2 wherein the attachment means comprises:

(a) extension members extending from each upper end of the body members, wherein the ends of the two upper horizontal members are rigidly connected to the extension members, and (b) pivot connection means pivotally connecting lower ends of the extension members to the upper ends of the body members allowing the distance between the two upper horizontal members to be adjusted and fixed in a chosen position.

4. The device of claim 1 wherein the center sections of the curved bottom surfaces are about one inch long and are curved end to end on a line with a radius of at least four inches and the rounded sections of the bottom surfaces have a radius of about one to about three inches.

5. The device of claim 1 wherein the center sections of the curved bottom surfaces are about one inch long and are curved end to end on a line with a radius of about three inches to about ten inches.

6. The device of claim 4 wherein the center sections of the curved bottom surfaces are about one inch long and are curved end to end on a line with a radius of about five inches and the rounded sections of the bottom surfaces have a radius of about two inches.

7. The device of claim 1 wherein a distance of upper horizontal surfaces above the center sections of the curved bottom surfaces is about three to five inches.

8. The device of claim 7 wherein a distance of upper horizontal surfaces above the center sections of the curved bottom surfaces is about four inches.

9. The device of claim 1 wherein the length of the upper horizontal surfaces and a distance between the curved bottom surfaces are both about four inches.

10. The device of claim 1 wherein at least one on the upper horizontal members comprises a plurality of rings positioned horizontally and sized to receive ends of the digits of the hand.

11. The device of claim 10 wherein the attachment means rotatably attaches the upper horizontal member comprising a plurality of rings to allow it to turn around a lengthwise axis.

12. A method of a person exercising a wrist comprising:

(A) providing a device comprising:

(i) two upper horizontal members each comprising two ends and a length with a horizontal top surface.

(ii) two body members each comprising:

(a) two upper ends, and (b) a curved bottom surface comprising:

(1) a center section that can rest on the surface and in combination support the device, and (2) two rounded sections extending from the center section in opposite directions, (iii) connection means to connect the two body members to fix the bottom surfaces in a parallel relationship to each other, wherein the bottom surfaces are in a curved plane which abuts the surface as the device is rocked back and forth, and (iv) attachment means:

(a) to attach the ends of the two upper horizontal members to the upper ends of the two body members, and (b) to fix the horizontal top surfaces of the two upper horizontal members:

(1) in parallel relationship to each other at a distance from each other that when the wrist of the one hand is rested flat on one horizontal top surface the tips of digits two through four of the hand span the distance and can rest on the opposite horizontal top surface, and (2) above the curved plane a sufficient distance that when the wrist of the one hand is rested flat on one horizontal top surface and the tips of digits two through four of the hand are rested on the opposite horizontal top surface and the device is rocked back and forth on the curved plane, the maximum range of motion of the wrist is reached, (B) placing the device on a flat surface resting on the curved bottom surfaces, (C) placing a wrist on the horizontal top surface of one of the upper horizontal members and at least one end of digits two through four of the same hand on the horizontal top surface of the remaining upper horizontal member spanning the distance between the horizontal top surfaces, and (D) rocking the device back and forth repetitively on the curved plane of the curved bottom surfaces.

13. The method of claim 12 further comprising:

(a) providing the device wherein at least one on the upper horizontal members comprises a plurality of rings positioned horizontally and sized to receive ends of the digits of the hand, and (b) inserting ends of the digits of the hand into the rings and resting an inside surface the wrist on the remaining upper horizontal member prior to rocking the device.

* * * * *